US010238152B2

(12) United States Patent
Rendone

(10) Patent No.: US 10,238,152 B2
(45) **Date of Patent: *Mar. 26, 2019**

(54) BRA WITH STORAGE POCKETS

(71) Applicant: NIKE, Inc., Beaverton, OR (US)

(72) Inventor: Nicole Rendone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/991,339

(22) Filed: May 29, 2018

(65) Prior Publication Data

US 2018/0332904 A1 Nov. 22, 2018

Related U.S. Application Data

(63) Continuation of application No. 15/597,364, filed on May 17, 2017, now Pat. No. 10,010,117.

(51) Int. Cl.
*A41C 3/00* (2006.01)

(52) U.S. Cl.
CPC ..... *A41C 3/0035* (2013.01); *A41C 3/0014* (2013.01); *A41C 3/0057* (2013.01)

(58) Field of Classification Search
CPC .... A41C 3/0035; A41C 3/0014; A41C 3/0057
USPC ..... 450/89, 86, 36, 54–57; 2/247, 250, 220, 2/76, 69, 67
See application file for complete search history.

(56) References Cited

U.S. PATENT DOCUMENTS 867,487 A 10/1907 Drennan
1,900,129 A 3/1933 Ring
2,149,819 A 3/1939 Rubinstein
2,436,430 A 2/1948 Hart
2,492,862 A * 12/1949 Harvey ..... A41C 3/0035 150/101
2,503,847 A 4/1950 Shanahan
2,593,711 A 4/1952 Weatherly
2,610,325 A 9/1952 Schlussel
2,624,881 A * 1/1953 Lee ..... A41C 3/0035 2/247
2,671,899 A 3/1954 Kroger
(Continued)

FOREIGN PATENT DOCUMENTS

CN 202566327 U 12/2012
CN 202566328 U 12/2012
(Continued)

OTHER PUBLICATIONS

"Women's Stow-N-Go Bra A/B" Last accessed Feb. 20, 2017 https://www.thenorthface.com/shop/womens-stow-n-go-bra-a-b-nf0a2tin-c1.

(Continued)

*Primary Examiner* — Gloria Hale
(74) *Attorney, Agent, or Firm* — Shook, Hardy and Bacon LLP

(57) ABSTRACT

Aspects herein are directed to a bra with multiple pockets positioned at different locations on the bra to provide a variety of storage options. The bra comprises one or more portions comprised of layers of material where the pocket spaces are formed between the layers of material. The layers of material of the different portions are joined along their perimeter edges except for one or more select areas that form openings in communication with the pocket spaces.

20 Claims, 11 Drawing Sheets

(56) References Cited

U.S. PATENT DOCUMENTS

| | | | | |
|---|---|---|---|---|
| 2,764,759 | A | 10/1956 | Gazelle | |
| 2,920,628 | A | 1/1960 | York | |
| 3,078,852 | A * | 2/1963 | Stapleton | A41C 3/00 450/89 |
| 3,459,191 | A | 8/1969 | Barg | |
| 3,518,998 | A | 7/1970 | Barg | |
| 3,565,081 | A | 2/1971 | Barg | |
| 4,666,432 | A | 5/1987 | McNeish et al. | |
| 5,067,178 | A | 11/1991 | Katchka | |
| 5,496,205 | A | 3/1996 | Lee | |
| 5,573,441 | A | 11/1996 | Smith | |
| D408,963 | S | 5/1999 | Consolo | |
| 6,099,382 | A | 8/2000 | Wilson | |
| 6,102,772 | A | 8/2000 | Fernandez | |
| 6,176,761 | B1 | 1/2001 | Underhill | |
| D448,541 | S | 10/2001 | Robinson | |
| 6,343,727 | B1 | 2/2002 | Leach | |
| 6,434,751 | B1 | 8/2002 | Gustafson et al. | |
| 6,517,410 | B1 | 2/2003 | Underhill | |
| 6,626,733 | B1 | 9/2003 | Knutson | |
| 6,993,940 | B2 * | 2/2006 | Rabinowicz | A41D 13/0015 2/250 |
| D522,717 | S | 6/2006 | Aurilia et al. | |
| 7,081,034 | B1 | 7/2006 | Zoellner | |
| D529,259 | S | 10/2006 | Faagau | |
| 7,234,996 | B1 | 6/2007 | Donker | |
| D554,326 | S | 11/2007 | Nuse | |
| 7,364,491 | B2 | 4/2008 | Updyke | |
| 7,396,274 | B2 | 7/2008 | Wiegmann | |
| D597,279 | S | 8/2009 | Spillman | |
| 7,585,200 | B1 | 9/2009 | McLaren | |
| 7,753,759 | B2 | 7/2010 | Pintor et al. | |
| D625,488 | S | 10/2010 | Messman et al. | |
| D630,816 | S | 1/2011 | Baramki | |
| D630,817 | S | 1/2011 | McKee | |
| 7,867,058 | B2 | 1/2011 | Sweeney | |
| D632,458 | S | 2/2011 | Shirer | |
| D646,461 | S | 10/2011 | Lewando | |
| D658,352 | S | 5/2012 | Pinner | |
| 8,216,023 | B2 | 7/2012 | Donnelly et al. | |
| 8,257,140 | B2 | 9/2012 | Kenny | |
| D668,837 | S | 10/2012 | Palladino | |
| 8,312,568 | B2 | 11/2012 | Marois et al. | |
| D686,389 | S | 7/2013 | Hayes et al. | |
| 8,484,763 | B1 | 7/2013 | Lucas | |
| D696,507 | S | 12/2013 | Tharp | |
| 8,597,071 | B2 | 12/2013 | Shweky et al. | |
| 8,597,072 | B1 * | 12/2013 | Lucas | A41C 3/0035 2/247 |
| 8,771,036 | B2 | 7/2014 | Gentry et al. | |
| 8,898,816 | B2 | 12/2014 | Highfield | |
| D725,872 | S | 4/2015 | Robinson | |
| 9,060,550 | B2 | 6/2015 | Conrad | |
| D733,394 | S | 7/2015 | Gentry et al. | |
| D737,021 | S | 8/2015 | Gonzales | |
| D741,566 | S | 10/2015 | Perry et al. | |
| D745,247 | S | 12/2015 | Mazard | |
| D750,868 | S | 3/2016 | Randall | |
| 9,289,016 | B1 | 3/2016 | Goff | |
| 9,295,288 | B1 | 3/2016 | Goff | |
| D753,370 | S | 4/2016 | Daniels | |
| 9,307,793 | B2 | 4/2016 | Kenny | |
| 9,408,420 | B2 | 8/2016 | Betts | |
| 9,456,639 | B2 | 10/2016 | Aylward | |
| 9,480,287 | B2 | 11/2016 | Black et al. | |
| 9,486,016 | B2 | 11/2016 | Cataldo | |
| D783,930 | S | 4/2017 | Rothert | |
| D801,628 | S | 11/2017 | Staub | |
| D808,114 | S | 1/2018 | Begriche et al. | |
| 9,943,120 | B1 * | 4/2018 | Rendone | A41C 3/0014 |
| 10,010,117 | B1 * | 7/2018 | Rendone | A41C 3/0014 |
| 2002/0174475 | A1 | 11/2002 | Mayr | |
| 2003/0101502 | A1 | 6/2003 | Hayes | |
| 2005/0075047 | A1 | 4/2005 | Zagame | |
| 2006/0121826 | A1 * | 6/2006 | Nazzaro | A41C 3/0035 450/89 |
| 2006/0258262 | A1 | 11/2006 | Wiegmann | |
| 2007/0270078 | A1 | 11/2007 | Henry | |
| 2007/0287359 | A1 | 12/2007 | Urushihata et al. | |
| 2007/0298684 | A1 | 12/2007 | Spagna | |
| 2009/0209173 | A1 | 8/2009 | Arledge et al. | |
| 2009/0300818 | A1 * | 12/2009 | Waite | A41D 1/14 2/76 |
| 2010/0281595 | A1 * | 11/2010 | Gernes | A41B 9/001 2/69 |
| 2011/0223832 | A1 * | 9/2011 | Rose | A41C 3/08 450/86 |
| 2011/0225700 | A1 | 9/2011 | Kogut | |
| 2011/0244758 | A1 | 10/2011 | Boatright et al. | |
| 2011/0275276 | A1 | 11/2011 | Shashy | |
| 2011/0277206 | A1 | 11/2011 | Sokolowski | |
| 2012/0028541 | A1 | 2/2012 | Donnelly et al. | |
| 2012/0034842 | A1 | 2/2012 | Roberts et al. | |
| 2012/0064799 | A1 | 3/2012 | Rivers | |
| 2012/0142253 | A1 | 6/2012 | Javaid et al. | |
| 2012/0276812 | A1 | 11/2012 | Wollowick | |
| 2012/0311758 | A1 * | 12/2012 | Nicholson | A41D 27/20 2/67 |
| 2013/0225042 | A1 | 8/2013 | Ave et al. | |
| 2013/0305433 | A1 * | 11/2013 | Hedrick | A41D 1/22 2/220 |
| 2014/0051331 | A1 | 2/2014 | Handras | |
| 2014/0106646 | A1 | 4/2014 | Delgado | |
| 2014/0115748 | A1 | 5/2014 | Berns et al. | |
| 2015/0080860 | A1 | 3/2015 | Farrell | |
| 2015/0289570 | A1 | 10/2015 | Conrad | |
| 2015/0296895 | A1 | 10/2015 | Muir | |
| 2015/0359273 | A1 * | 12/2015 | Olson | A41B 9/001 2/250 |
| 2016/0058079 | A1 | 3/2016 | Sexton | |
| 2016/0095372 | A1 | 4/2016 | Peterson et al. | |
| 2016/0143424 | A1 * | 5/2016 | Stephens | A45F 3/005 224/222 |
| 2017/0202274 | A1 | 7/2017 | Blackwell | |
| 2017/0360118 | A1 | 12/2017 | Randall et al. | |

FOREIGN PATENT DOCUMENTS

| | | | |
|---|---|---|---|
| DE | 3203872 | A1 | 8/1983 |
| DE | 202015104392 | A1 | 10/2015 |
| DE | 102014018984 | A1 | 6/2016 |
| EP | 1673992 | A1 | 6/2006 |
| FR | 2558347 | A1 | 7/1985 |
| GB | 2468175 | A | 9/2010 |
| JP | H10237705 | A | 9/1998 |
| JP | 2001020105 | A | 1/2001 |
| JP | 2002027075 | A | 1/2002 |
| WO | 2016011490 | A1 | 1/2016 |

OTHER PUBLICATIONS

"Zoot: Run Moonlight Bra Women's" Last accessed Feb. 20, 2017 https://www.rei.com/rei-garage/product/100450/zoot-run-moonlight-bra-womens.

"The Bra With Pockets!"; May 2, 2014 http://web.archive.org/web/20140502060922/http://pocketbra.com/.

"Hydro Pocket"; Aug. 22, 2014 http://web.archive.org/web/20140822054752/http://hydro-pocket.com/.

"Luana Cross Strap Pocket Sports Bra" Last accessed Feb. 20, 2017 http://www.swoob.com/fitness-fashion-sportswear/swoob-luana-cross-strap-sports-bra.

"Sarah Sports Bra Bahamas" Last accessed Feb. 20, 2017 https://www.senitaathletics.com/products/sarah-sports-bra-bahamas.

"JoeyBra, the first sexy and comfortable pocketed bra!" Last accessed Feb. 20, 2017 https://www.kickstarter.com/projects/1094440554/joeybra-the-first-sexy-and-fashionable-pocketed-br.

"Apex Compression Sports Bra" Last accessed Feb. 20, 2017 https://www.sportportactive.com/shop/apex-sports-bra/.

"Gracie's Gear Sports Bra" Last accessed Feb. 20, 2017 https://www.graciesgearandtraining.com/store/sports-bra-pocket-pink/.

(56) References Cited

OTHER PUBLICATIONS

"Gracie's Gear Long Tank" Last accessed Feb. 20, 2017 https://www.graciesgearandtraining.com/store/gracies-gear-long-tank/.
"Pocket Bra Cups" Last accessed Feb. 20, 2017 http://kickended.com/projects/1125757884/.
"Lululemon Neon Pink Pack It in Bra", Feb. 20, 2017 Last accessed Sep. 1, 2017 https://www.amazon.com/Lululemon-Neon-Pink-Pack-Bra/dp/B01KVUR86C.
"Cleavage Caddy Snaps to Bras, Gives Women a Secret Purse Underneath Their Blouses" http://www.coolthings.com/cleavage-caddy-snaps-to-bras-gives-women-a-secret-purse-underneath-their-blouses/.
"Secret Stash Bra Pocket" Last accessed Feb. 20, 2017 https://brazabra.com/dressing-solutions-personal-care/secret-stash-bra-pocket/.
International Search Report and Written Opinion dated Aug. 20, 2018 in International Patent Application No. PCT/US2018/033081, 16 pages.

* cited by examiner

BRA WITH STORAGE POCKETS

CROSS-REFERENCE TO RELATED APPLICATIONS

This application having U.S. application Ser. No. 15/991,339, entitled "Bra with Storage Pockets," and filed May 29, 2018 is a Continuation Application of U.S. application Ser. No. 15/597,364, entitled "Bra with Storage Pockets," filed May 17, 2017, and issued as U.S. Pat. No. 10,010,117 on Jul. 3, 2018. The entirety of the aforementioned application is incorporated by reference herein.

TECHNICAL FIELD

Aspects herein relate to a bra having pockets for stowing items.

BACKGROUND

Bras, especially sport bras, are generally worn to support a wearer's breasts during, for example, athletic activities. These bras generally lack pocket structures for stowing items which may inconvenience the wearer.

BRIEF DESCRIPTION OF THE DRAWINGS

Examples of the present invention are described in detail below with reference to the attached drawings figures, wherein.

DETAILED DESCRIPTION

Figure 1:
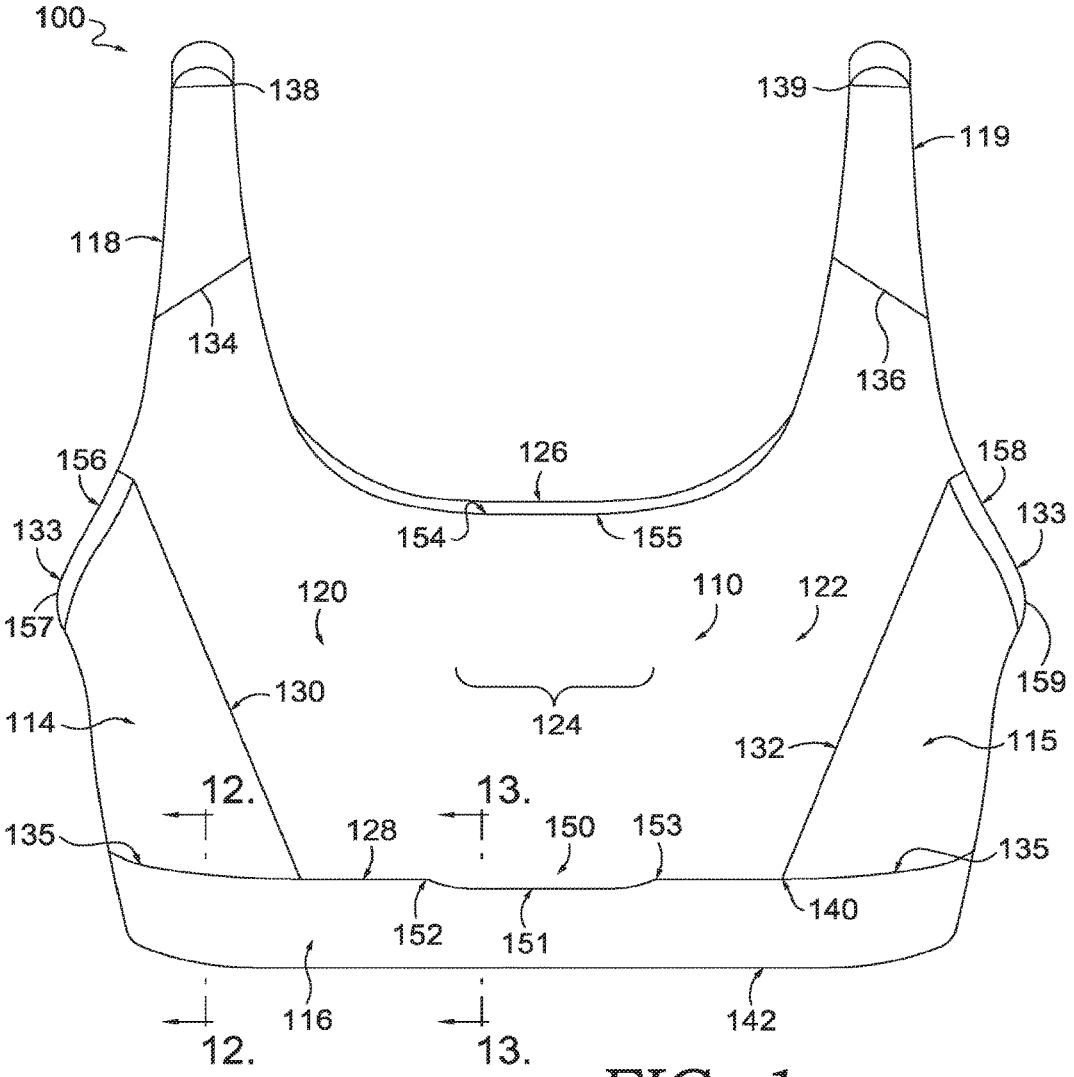
FIG. 1 illustrates a front view of an exemplary bra with storage pockets in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a support garment, such as a bra, having storage pockets positioned at multiple different locations on the bra to meet the different preferences of a wearer. Female wearers often want and need to store items during training but prefer not to carry additional accessories to stow the items such as fanny packs, shoulder packs, and the like. By providing a bra with multiple storage pockets positioned at different locations, the wearer can not only store a number of items but can choose which location best suits her needs.

In exemplary aspects, the pockets are constructed by forming the different portions of the bra (e.g., front portion, back portion, side portions, and underband portion) from two or more layers of material and selectively attaching the layers along their perimeter edges to define pocket spaces between the layers of material. Low-profile openings to the pocket spaces are formed by not attaching the layers of material at one or more locations along their perimeter edges. In other words, areas where the perimeter edges of the layers of material are unaffixed to each other comprise openings in communication with the pocket spaces. This construction method may be used to form pockets in the front portion of the bra, the back portion of the bra, the side portions of the bra, as well as the underband portion of the bra. Moreover, by configuring the pocket spaces between the layers of the bra, and by forming the pocket openings along the perimeter edges of the different bra portions, the pockets are generally low profile and are less of a distraction to the wearer. As well, they provide a cleaner aesthetic to the bra.

Accordingly, aspects herein are directed to a bra comprising a front portion, a back portion, and a pair of side portions, where the pair of side portions connect the front portion and the back portion of the bra. The bra further comprises an underband portion extending from a lower margin of the front portion, the back portion, and the pair of side portions of the bra, where the underband portion comprises at least a first layer of material and a second layer of material positioned adjacent and external to the first layer of material. As well, the bra comprises a first pocket space formed between the first layer of material and the second layer of material of the underband portion.

In another aspect, a bra is provided comprising a front portion, and a back portion. The back portion comprises a first layer of material having a superior edge forming an upper margin of the back portion and an inferior edge forming a lower margin of the back portion, a second layer of material positioned adjacent and external to the first layer of material to form a first pocket space, where the second layer of material has a superior edge and an inferior edge. The inferior edge of the second layer of material is affixed to the first layer of material, and the superior edge of the second layer of material is unaffixed along at least a portion of its length to the first panel to form a first pocket opening communicating with the first pocket space. The back portion further comprises a third layer of material positioned adjacent and external to the first layer of material to form a second pocket space. The third layer of material has a superior edge generally coincident with the inferior edge of the second layer of material and an inferior edge generally coincident with the inferior edge of the first layer of material. The inferior edge of the third layer of material is affixed to the first layer of material, and the superior edge of the third layer of material is unaffixed along at least a portion of its length to the first layer of material to form a second pocket opening in communication with the second pocket space. The bra further comprises a pair of side portions, where the pair of side portions connect the front portion and the back portion of the bra.

In yet another aspect, a bra is provided comprising a front portion, and a back portion. The back portion comprises at least a first layer of material having a superior edge forming an upper margin of the back portion and an inferior edge forming a lower margin of the back portion, a second layer of material positioned adjacent and external to the first layer of material to form a first pocket space, and a third layer of material positioned adjacent and external to the first layer of material to form a second pocket space. The bra further comprises a pair of side portions, where the pair of side portions connect the front portion and the back portion of the bra, and an underband portion extending from a lower margin of the front portion, the back portion, and the pair of side portions of the bra. The underband portion comprises at least a first layer of material and a second layer of material positioned adjacent and external to the first layer of material. A third pocket space is formed between the first layer of material and the second layer of material of the underband portion.

Although the term "bra" is used herein, it is contemplated that the term "bra" may apply to other types of support garments such as tank tops, camisoles with built-in support, swimming suit tops, body suits, and other styles or types of support garments used to support breast tissue. Further, positional terms used herein such as "superior," "inferior," "medial," "lateral," "upper," "lower," "side," "front," "back," and the like are to be given their common anatomical meaning with respect to the bra being worn by a hypothetical wearer standing in anatomical position. Further, the term "breast contacting surface" is meant to encompass any type of structure that is in contact with the wearer's breasts. For instance, each breast contacting surface may comprise a breast cup such as a molded cup, or an unmolded cup. The breast contacting surfaces may comprise separate distinct components with each contacting surface configured to cover or encapsulate a separate breast, or the breast contacting surfaces may comprise a unitary or continuous band of material that makes contact with both of the wearer's breasts. Any and all aspects, and any variation thereof, are contemplated as being within aspects herein. Still further, the phrase "configured to contact," when describing different portions of the bra in relation to a wearer refers to a bra appropriately sized for the particular wearer.

Figure 2:
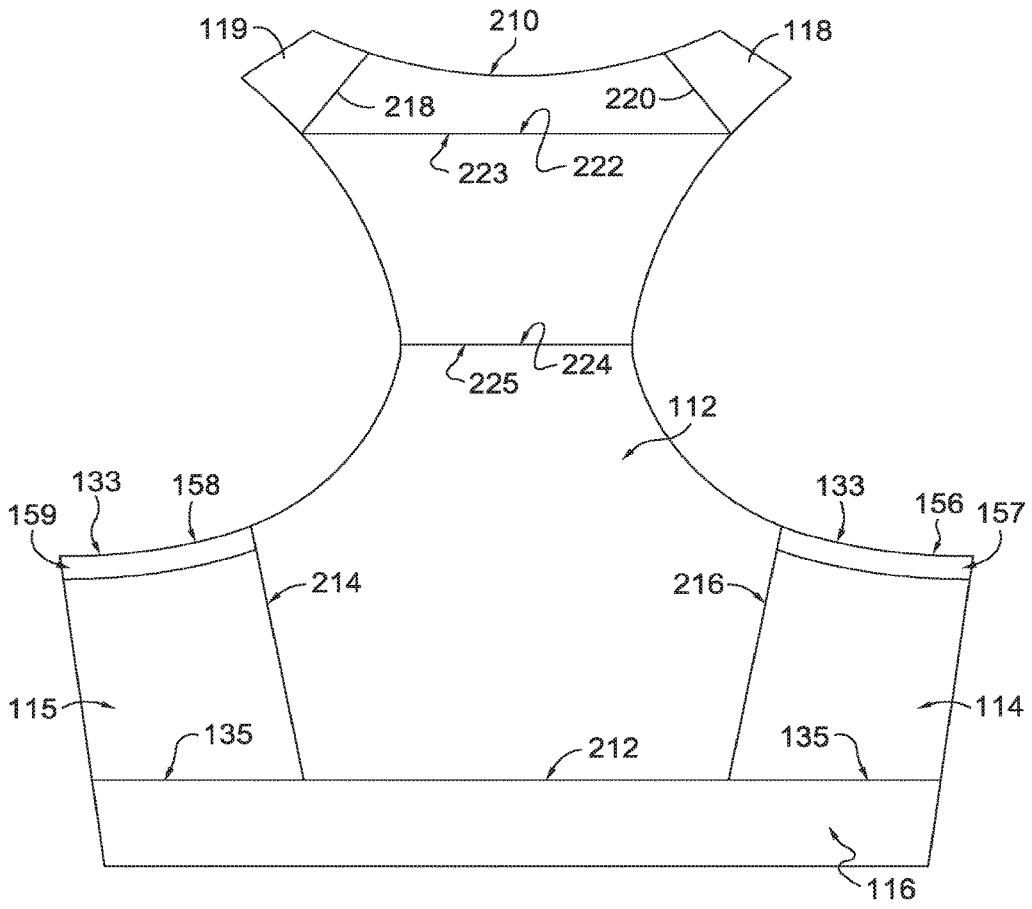
FIG. 2 illustrates a back view of the exemplary bra of FIG. 1 in accordance with aspects herein.

Turning now to FIGS. 1 and 2, front and back views respectively of an exemplary bra 100 having storage pockets are shown in accordance with aspects herein. In exemplary aspects, the bra 100 comprises a front portion 110, a back portion 112, side portions 114/115, an underband portion 116, and shoulder straps 118/119. In one aspect, the different portions 110, 112, 114/115, 116, and 118/119 may comprise separate constructions that are joined together at one or more seam lines using affixing technologies such as stitching, bonding, welding, adhesives, and the like. In other aspects, the different portions 110, 112, 114/115, 116, and 118/119 may comprise integral extensions of one another. For instance, a knitting or weaving process may be used to seamlessly and integrally knit or weave the different portions 110, 112, 114/115, 116, and 118/119 to form the bra 100. In yet another aspect, one or more of the portions 110, 112, 114/115, 116, or 118/119 may be seamlessly and integrally knit or woven with another portion while remaining portions may comprise separate constructions that are joined to the integrally knit or woven portions using affixing technologies described herein. Any and all aspects, and any variation thereof, are contemplated as being within aspects herein.

Turning first to the front portion 110, the front portion 110 is configured to contact at least a wearer's breasts when the bra 100 is in an as-worn configuration. In exemplary aspects, the front portion 110 may comprise a first breast contacting surface 120, a second breast contacting surface 122, and a central portion 124 positioned between the first and second breast contacting surfaces 120 and 122. The front portion 110 further comprises at least an upper margin 126, a lower margin 128, and side margins 130 and 132. The front portion 110 may be formed from one or materials configured to provide at least a moderate amount of compression to help support the wearer's breasts.

The back portion 112 is configured to contact at least a portion of the wearer's back torso when the bra 100 is in the as-worn configuration. In exemplary aspects, the back portion 112 may comprise a "racerback" style having at least an upper margin 210, a lower margin 212, and side margins 214 and 216. The back portion 112 may be formed, in exemplary aspects, of a mesh material to provide breathability and air permeability to the bra 100 although uses of other types of materials are contemplated herein.

The bra further comprises side portions 114/115 configured to extend around the side torso areas of a wearer when the bra 100 is in the as-worn configuration. The side portions 114/115 connect the front portion 110 to the back portion 112 of the bra 100 around the torso of the wearer when the bra 100 is worn. More specifically, in exemplary aspects, the side portion 114 may be affixed to the front portion 110 at the side margin 130 of the front portion 110 and to the back portion 112 at the side margin 216 of the back portion 112. Continuing, the side portion 115 may be affixed to the front portion 110 at the side margin 132 of the front portion 110 and to the back portion 112 at the side margin 214 of the back portion 112. Thus, in some aspects, the margins 130, 132, 214, and 216 may comprise "seam lines," "seams," or areas where two or more panels of material are joined together using affixing technologies described herein. However, it is also contemplated herein that when the front portion 110, side portions 114/115 and back portion 112 comprise integrally knit or woven extensions of each other, the different margins 130, 132, 214, and 216 may comprise lines of demarcation between the different portions created via a knitting process, a weaving process, and the like. In other words, the different margins 130, 132, 214, and 216 may comprise areas where two or more layers of material are joined together via a knitting process, a weaving process, and the like, to create boundaries for the various pockets described herein. Any and all aspects, and any variation thereof, are contemplated as being within aspects herein.

Continuing, the side portions 114/115 may each comprise an upper margin 133 and a lower margin 135. In exemplary aspects, some or all of the side portions 114/115 may be formed of a mesh material to provide breathability and air permeability to the bra 100 although uses of other types of materials are contemplated herein.

The shoulder straps 118/119 of the bra 100 are configured to extend over the shoulder areas of the wearer when the bra 100 is in the as-worn configuration. However, it is also contemplated herein that the shoulder straps 118/119 may be optional. When not used, the bra 100 would assume a bandeau style garment. When used, the shoulder straps 118/119 also help to connect the front portion 110 to the back portion 112. More particularly, in exemplary aspects, the shoulder strap 118 may be affixed to the front portion 110 at seam line 134 and to the back portion 112 at seam line 220, and the shoulder strap 119 may be affixed to the front portion 110 at the seam line 136 and to the back portion 112 at seam line 218. However, it is also contemplated herein that the shoulder straps 118/119 may comprise integrally knit or woven extensions of the front portion 110 and/or the back portion 112. In this instance, the seam lines 134, 136, 218, and 220 may comprise lines of demarcation between the different portions of the bra 100 created via, for instance, a knitting or weaving process. Any and all aspects, and any variation thereof, are contemplated as being within aspects herein.

Further, in exemplary aspects, the shoulder straps 118/119 may be formed of a low-stretch material so as to provide further support to the wearer's breasts when the bra 100 is in the as-worn configuration. Additionally, in an exemplary aspects, the shoulder straps 118/119 may optionally comprise a first loop 138 positioned on the shoulder strap 118 and/or a second loop 139 positioned on the second shoulder strap 119. The first and second loops 138/139 may be formed from the same material or a different material from that used to form the shoulder straps 118/119 and may be used to secure, for instance, straws for water bladders, or wires for headphones.

The bra 100 additionally comprises the underband portion 116, where the underband portion 116 is configured to extend circumferentially around the torso area of the wearer when the bra 100 is in the as-worn configuration. In exemplary aspects, the underband portion 116 extends from the lower margin 128 of the front portion 110, the lower margins 135 of the side portions 114/115, and the lower margin 212 of the back portion 112. The underband portion 116 comprises an upper margin 140 and a lower margin 142. In exemplary aspects, the underband portion 116 may be formed from the same material used to form, for instance the front portion 110. The material may exhibit some degree of elastic resilience to help tension the underband portion 116 against the torso of a wearer when the bra 100 is worn. In some aspects, an additional elastically resilient band may be used in the underband portion 116 to provide further tensioning when the bra 100 is worn.

The bra 100 comprises a number of different storage pockets in accordance with aspects herein. For instance, with respect to FIG. 1, the bra 100 may comprise pocket 150 having an opening 151 positioned at the upper margin 140 of the underband portion 116. In exemplary aspects, the opening 151 to the pocket 150 may be positioned generally inferior to the central portion 124 of the front portion 110. In other words, the opening 151 may be generally vertically aligned with the central portion 124 of the bra 100. The opening 151 may comprise a first end 152 and a second end 153 that define the length of the opening 151.

Still referring to FIG. 1, the bra 100 may comprise pocket 154 having an opening 155 positioned adjacent to the upper margin 126 of the front portion 110. In exemplary aspects, the opening 155 may extend the length of the upper margin 126 of the front portion 110 to provide the wearer with easy access to the storage pocket 154. Continuing, and with respect to FIGS. 1 and 2, the bra 100 further comprises pocket 156 located at side portion 114 and pocket 158 located at side portion 115. The pocket 156 comprises opening 157 positioned at the upper margin 133 of side portion 114, and the pocket 158 comprises opening 159 at the upper margin 133 of side portion 115. In exemplary aspects, the openings 157 and 159 may extend along the length of the upper margin 133 of side portions 114 and 115. Further, it is contemplated herein, that the bra 100 may comprise just one of the pockets 156 and/or 158 or both the pockets 156 and 158. Any and all aspects, and any variation thereof, are contemplated as being within aspects herein.

The bra 100 may additionally comprise pocket 222 having an opening 223 located on the back portion 112 of the bra 100. The opening 223 may be offset from and inferior to the upper margin 210 of the back portion 112. Additionally, the back portion 112 may comprise a second pocket 224 having an opening 225. The opening 225 to the second pocket 224 may be offset from and inferior to the opening 223 of the pocket 222. In exemplary aspects, both the opening 223 and the opening 225 may extend across the width of the back portion 112. The various openings 151, 155, 157, 159, 223, and 225 to the pockets 150, 154, 156, 158, 222, and 224 described herein may be reinforced with, for example, seam tape, elasticized tape, piping, additional fabric, and the like to facilitate enhanced durability of the bra 100 through repeated use of the various pockets 150, 154, 156, 158, 222, and 224.

Figure 3:
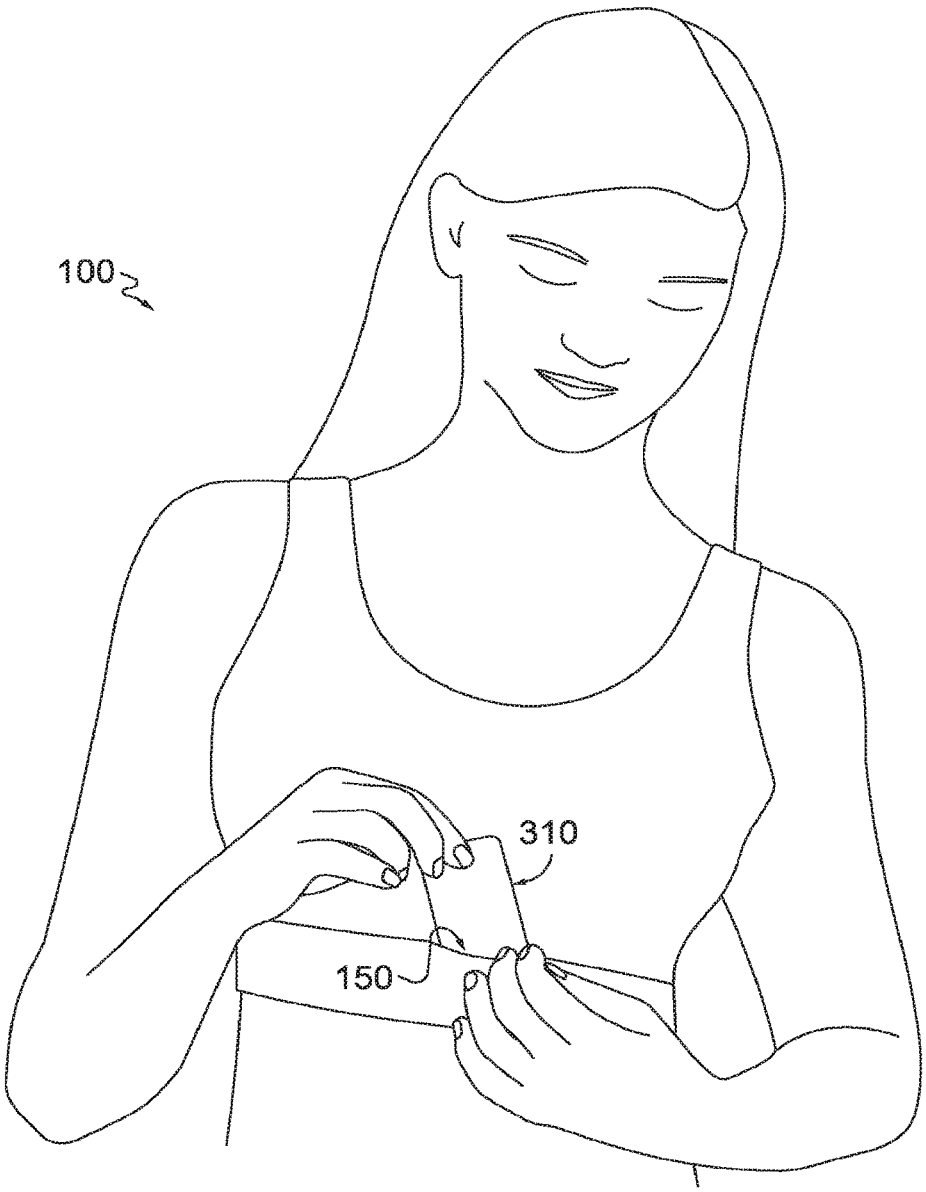
FIGS. 3-6 illustrate the exemplary bra of FIGS. 1 and 2 in various in-use configurations in accordance with aspects herein.
Figure 4:
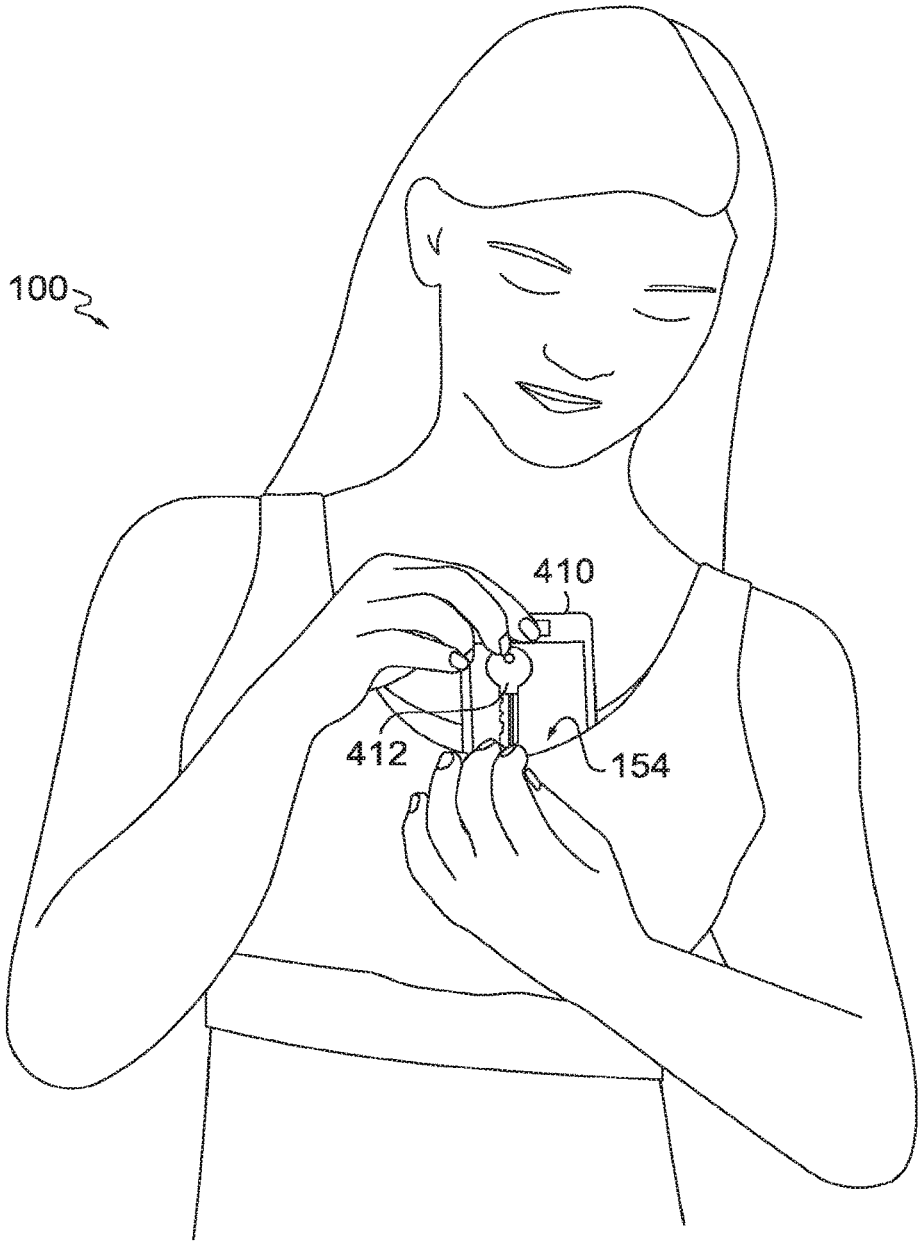

The pockets 150, 154, 156, 158, 222, and 224 and their associated openings 151, 155, 157, 159, 223, and 225 are strategically located to provide the wearer of the bra 100 with different placement options for stowing items in accordance with preferences of the wearer. Moreover, the size of the pockets 150, 154, 156, 158, 222, and 224 and their associated openings 151, 155, 157, 159, 223, and 225 are configured to vary in size to provide secure storage for different sized items. Some examples of different use configurations are shown in FIGS. 3-6. FIGS. 3-4 depict front views of the bra 100 being worn by a wearer in accordance with aspects herein. With respect to FIG. 3, an item 310, in the form of an identification card, is shown as being stowed within the pocket 150. FIG. 4 illustrates an item 410, in the form of a cell phone, being stowed within the pocket 154, and an item 412, in the form of a set of keys, also being stowed within the pocket 154.

Figure 5:
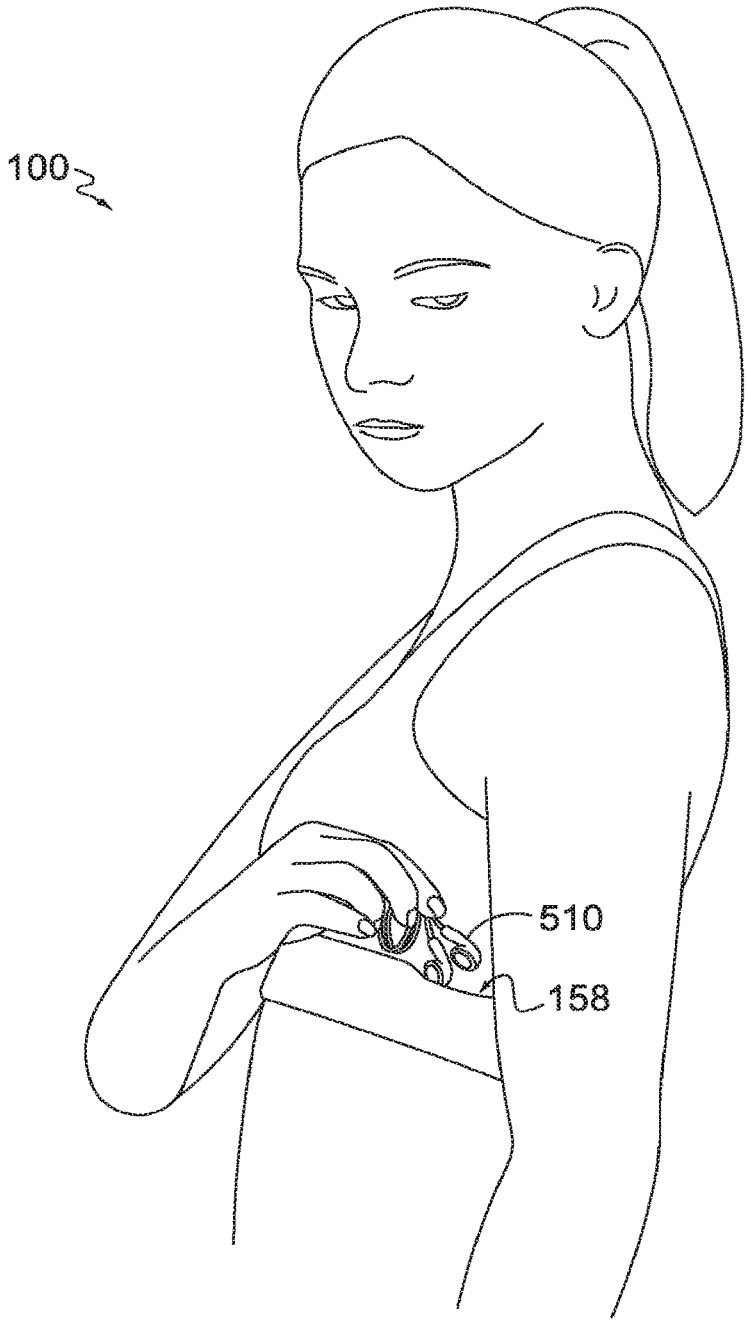
Figure 6:
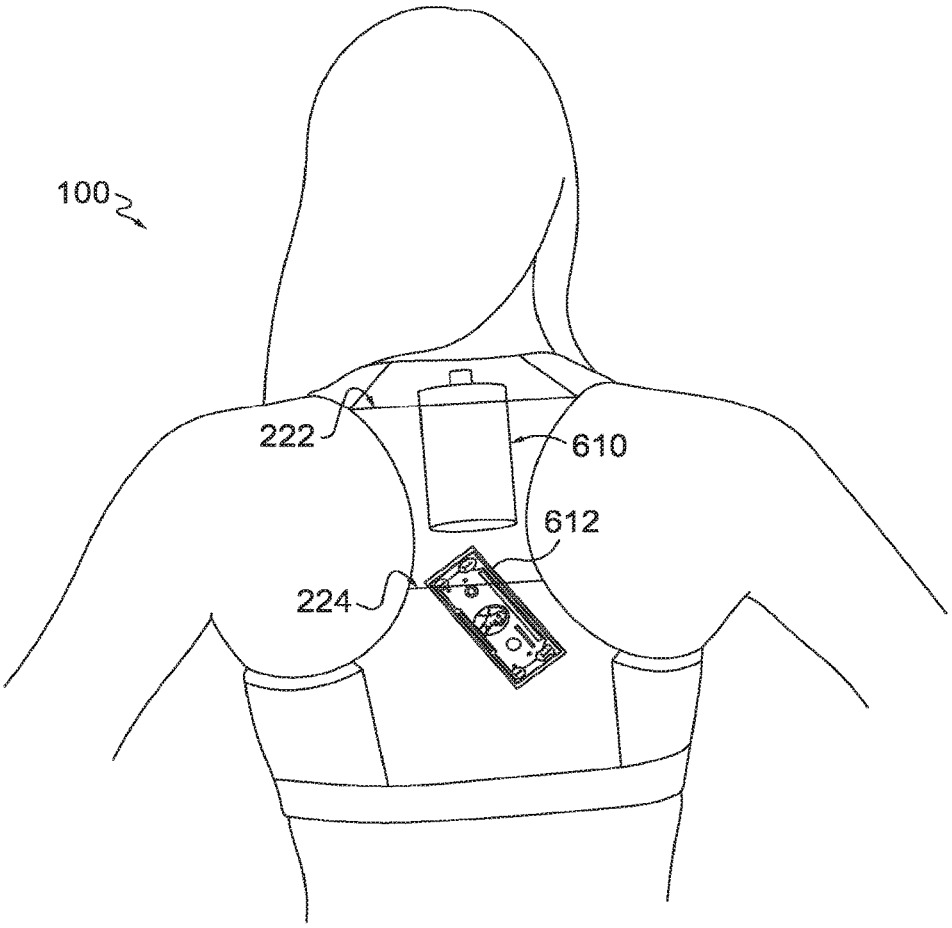

FIG. 5 depicts a side view of the bra 100 being worn. An item 510, in the form of ear buds, is shown being stowed in the pocket 158. FIG. 6, which depicts a back view of the bra 100 being worn by the wearer, illustrates an item 610, in the form of a water bottle, being stowed in the pocket 222, and an item 612, in the form of money, being stowed in the second pocket 224. The items shown in FIGS. 3-6 are exemplary only and are provided to illustrate the different uses of the pockets 150, 154, 156, 158, 222, and 224. Other types of stowable items are contemplated as being within the scope herein.

Figure 7:
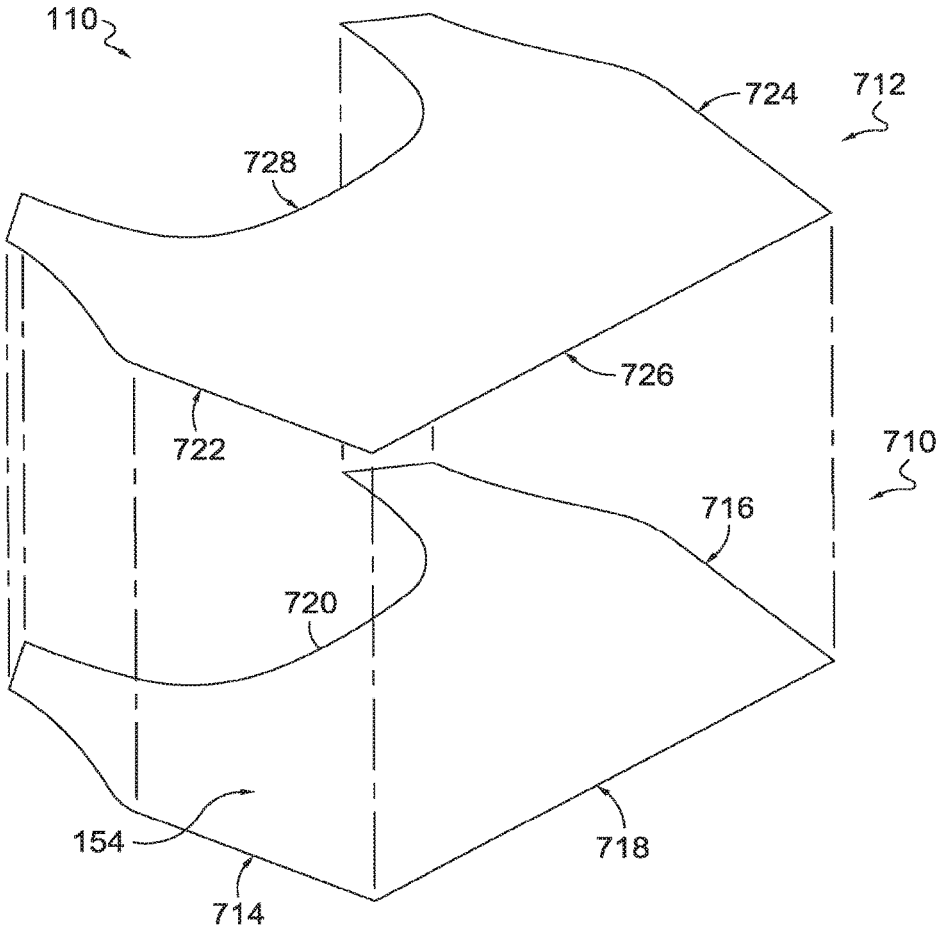
FIG. 7 illustrates an exploded view of a front portion of the exemplary bra of FIGS. 1 and 2 in accordance with aspects herein.

Turning now to FIG. 7, an exploded view of the front portion 110 of the bra 100 is provided in accordance with aspects herein. As discussed above, the various pockets of the bra 100 are constructed by forming the different portions of the bra 100 of two or more layers of material. The pocket space is formed between the layers of material, and an opening to the pocket space is formed by discontinuously affixing the perimeter edges of the different portions at select areas. With respect to FIG. 7, the front portion 110 comprises at least a first layer of material 710 and a second layer of material 712. The first layer of material 710 is defined by at least perimeter edges 714, 716, 718, and 720. Perimeter edges 714 and 716 oppose each other and help to define the side margins 130 and 132 of the front portion 110 respectively. Perimeter edges 718 and 720 also oppose each other. Perimeter edge 718 helps to define the lower margin 128 of the front portion 110, and perimeter edge 720 helps to define the upper margin 126 of the front portion 110.

The second layer of material 712 is configured to be positioned adjacent and external to the first layer of material 710 when the bra 100 is assembled such that respective surfaces of each are positioned adjacent to each other. The second layer of material 712 is defined by at least perimeter edges 722, 724, 726, and 728. Perimeter edges 722 and 724 oppose each other and further help to define the side margins 130 and 132 of the front portion 110 respectively. Perimeter edges 726 and 728 also oppose each other. Perimeter edge 726 further helps to define the lower margin 128 of the front portion 110, and perimeter edge 728 further helps to define the upper margin 126 of the front portion 110.

When assembled, the perimeter edge 722 of the second layer of material 712 may be affixed to the perimeter edge 714 of the first layer of material 710 along their respective lengths using affixing technologies known in the art (e.g., stitching, bonding, adhesives, and the like). When the different bra portions comprise integrally knit or woven extensions of each other, the perimeter edge 722 and the perimeter edge 714 may be more accurately described as boundaries, where the boundaries are integrally knit or woven to each other along their respective lengths to define the boundaries of the different pocket spaces. Thus, as used herein, the term "affixing" may also mean integrally knitting or weaving one or more perimeter edges or boundaries to each other to create lines of demarcation between the different bra portions and to define boundaries for the different pockets described herein.

Continuing, the perimeter edge 724 may be affixed to the perimeter edge 716 of the first layer of material 710 along their respective lengths, and the perimeter edge 726 of the second layer of material 712 may be affixed to the perimeter edge 718 of the first layer of material 710 along their respective lengths. The pocket 154 is formed between the two layers of material 710/712. As such, the pocket 154 extends without interruption between the two layers of material 710/712 forming the front portion 110. To put it another way, the pocket 154 extends without interruption between the two layers of material 710/712 from the side margin 130 to the side margin 132. The opening 155 to the pocket 154 is formed by not affixing the perimeter edge 720 of the first layer of material 710 to the perimeter edge 728 of the second layer of material 712 along their respective lengths. This construction provides a large opening and easy access to the pocket 154. However, it is contemplated herein, that at least a portion of the perimeter edge 720 may be affixed to at least a portion of the perimeter edge 728 to provide a smaller opening 155 to the pocket 154. Any and all aspects, and any variation thereof, are contemplated as being within aspects herein.

Figure 8:
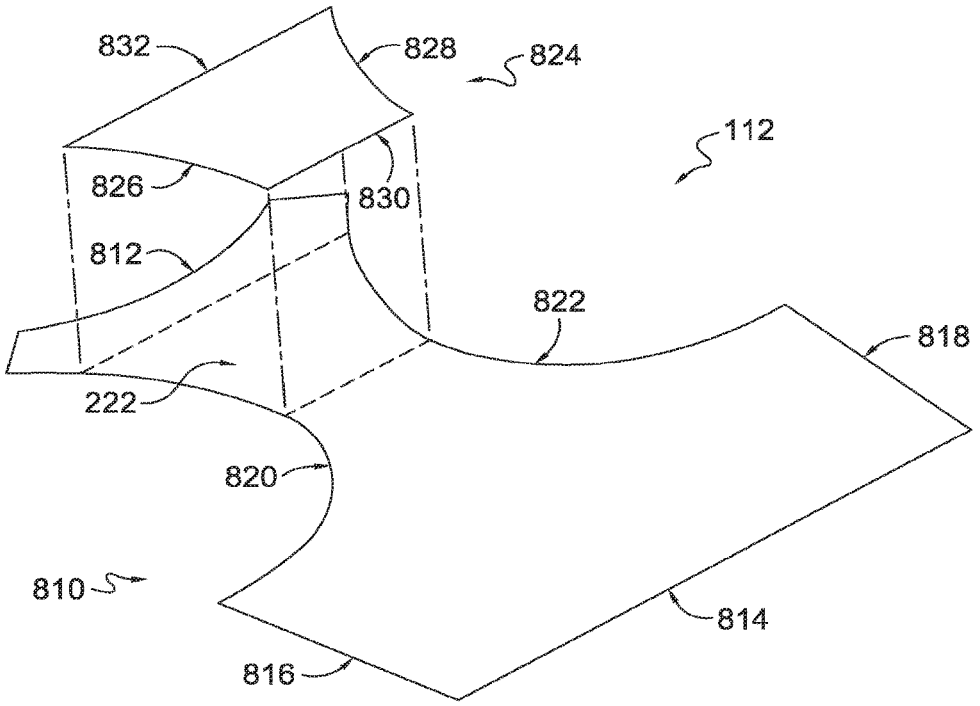
FIG. 8 illustrates a first exploded view of a back portion of the exemplary bra of FIGS. 1 and 2 in accordance with aspects herein.

With respect to FIG. 8, an exploded view of the back portion 112 is illustrated in accordance with aspects herein. More specifically, FIG. 8 is provided to illustrate how the pocket 222 is formed. The back portion 112 comprises a first layer of material 810, which may be an elastically resilient mesh material for air permeability and breathability that is defined by at least perimeter edges 812, 814, 816, 818, 820, and 822. The perimeter edge 812 comprises the upper margin 210 of the back portion 112, while the perimeter edge 814 comprises the lower margin 212 of the back portion 112. The perimeter edges 816 and 818 comprise the side margins 214 and 216 of the back portion 112. The perimeter edges 820 and 822 help to form or define the armholes of the bra 100.

The pocket 222 is formed by positioning a second layer of material 824, which may be an elastically resilient mesh material, adjacent and external to the first layer of material 810 such that the respective surfaces of each are adjacent to each other to define a pocket space therebetween. The second layer of material 824 is defined by perimeter edges 826, 828, 830 and 832. The perimeter edges 826 and 828 oppose each other and define side margins of the second layer of material 824. The perimeter edge 830 defines a lower margin of the second layer of material 824, and the perimeter edge 832, which opposes the perimeter edge 830, defines an upper margin of the second layer of material 824. When assembled, the perimeter edges 826 and 828 of the second layer of material 824 are affixed to an upper portion of the perimeter edges 820 and 822 of the first layer of material 810 along their respective lengths, and the perimeter edge 830 of the second layer of material 824 is affixed to the first layer of material 810 along its respective length at a location approximately one-third the distance from the perimeter edge 812 to the perimeter edge 814 as measured with respect to the perimeter edge 812. To form the opening 223, the perimeter edge 832 of the second layer of material 824 is not affixed (or is unaffixed) to the first layer of material 810 to provide access to the pocket 222. When assembled, the opening 223 is offset from or spaced apart from the upper margin 210 of the back portion 112 by a distance of approximately 1 cm, 2 cm, 3 cm, up to 10 cm.

Figure 9:
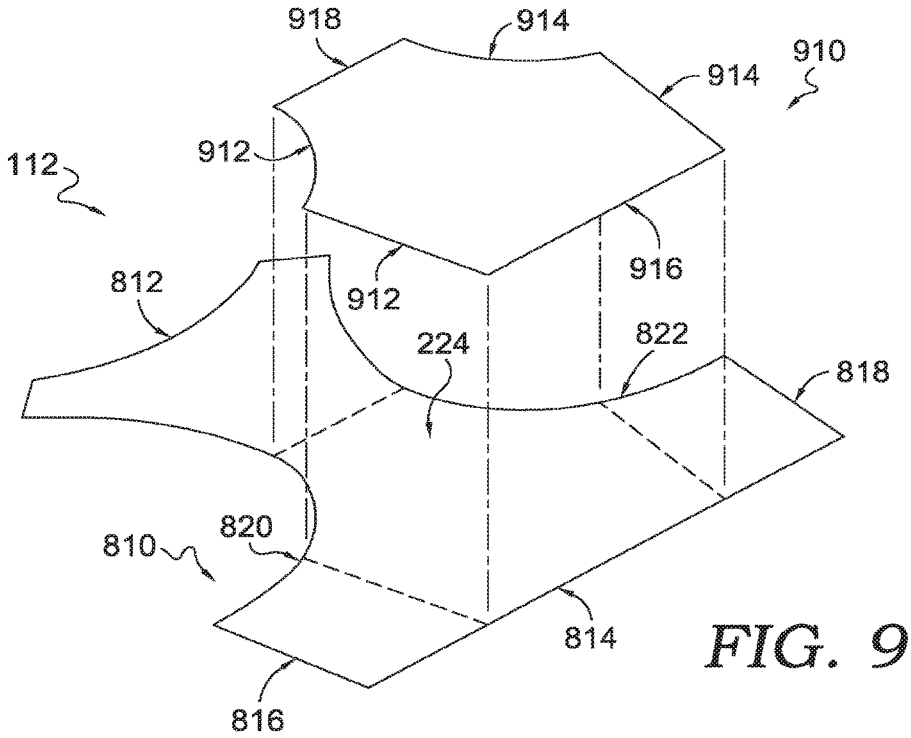
FIG. 9 illustrates a second exploded view of the back portion of the exemplary bra of FIGS. 1 and 2 in accordance with aspects herein.

Turning now to FIG. 9, a second exploded view of the back portion 112 is provided in accordance with aspects herein. More specifically, FIG. 9 is provided to illustrate how the second pocket 224 is formed. The first layer of material 810 is shown with its perimeter edges 812, 814, 816, 818, 820, and 822. A third layer of material 910, which may be an elastically resilient mesh material, is also shown, where the third layer of material 910 is defined by at least perimeter edges 912, 914, 916, and 918. The perimeter edges 912 and 914 generally oppose each other and define side margins of the third layer of material 910. The perimeter edge 916 comprises a lower margin of the third layer of material 910, and the perimeter edge 918 comprises an upper margin of the third layer of material 910.

The second pocket 224 is formed by positioning the third layer of material 910 adjacent and external to the first layer of material 810 such that the respective surfaces of each are adjacent to each other to define a pocket space therebetween. When assembled, the perimeter edges 912 and 914 of the third layer of material 910 are affixed the first layer of material 810 along their respective lengths, and the perimeter edge 916 of the third layer of material 910 is affixed to the perimeter edge 814 of the first layer of material 810 along its respective length. To form the opening 225, the perimeter edge 918 of the third layer of material 910 is not affixed (or is unaffixed) to the first layer of material 810 to provide access to the second pocket 224.

It is contemplated herein that the perimeter edge 830 of the second layer of material 824 is coincident with, or aligned with, the perimeter edge 918 of the third layer of material 910 such that the opening 225 is generally aligned with the perimeter edge 830 of the second layer of material 824. To describe it another way, it is contemplated herein that the second layer of material 824 does not substantially overlap with the third layer of material 910 such that the pocket 222 does not significantly overlap with the second pocket 224. This holds true even though at least one edge of the pocket 222 may align with at least one edge of the second pocket 224. This construction allows for two distinct pocket spaces with separate access to each so that a wearer can separately stow items in the pockets 222 and 224 with unnecessary interference between the pockets 222 and 224.

Figure 10:
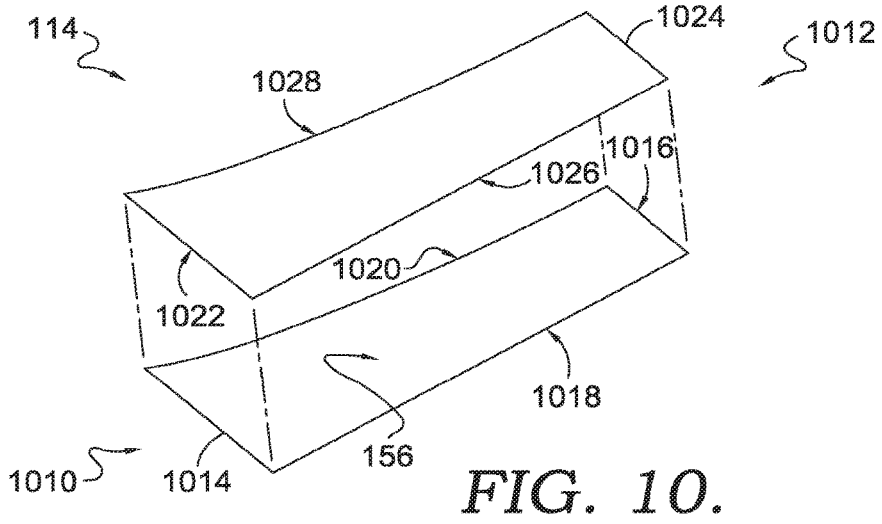
FIG. 10 illustrates an exploded view of a side portion of the exemplary bra of FIGS. 1 and 2 in accordance with aspects herein.

FIG. 10 illustrates an exploded view of the side portion 114 of the bra 100 in accordance with aspects herein. The description of FIG. 10 would be equally applicable to the side portion 115 of the bra 100. FIG. 10 is specifically provided to illustrate how the pocket 156 is formed. The side portion 114 comprises a first layer of material 1010 and a second layer of material 1012. In exemplary aspects, both the first layer of material 1010 and the second layer of material 1012 may comprise an elastically resilient mesh material for breathability and air permeability. It is also contemplated herein that just the second layer of material 1012 may comprise an elastically resilient mesh material, or just the first layer of material 1010 may comprise an elastically resilient mesh material. The first layer of material 1010 is defined by perimeter edges 1014, 1016, 1018, and 1020. The perimeter edges 1014 and 1016 oppose each other and define front and back margins respectively when the side portion 114 is incorporated into the bra 100. The perimeter edge 1020 comprises at least in part the upper margin 133 of the side portion 114, and the perimeter edge 1022 comprises at least in part the lower margin 135 of the side portion 114 of the bra 100.

The second layer of material 1012 is defined by perimeter edges 1022, 1024, 1026, and 1028. The perimeter edges 1022 and 1024 oppose each other and define front and back margins respectively when the side portion 114 is incorporated into the bra 100. The perimeter edge 1028 comprises at least in part the upper margin 133 of the side portion 114, and the perimeter edge 1026 comprises at least in part the lower margin 135 of the side portion 114 of the bra 100.

To form the pocket 156, the second layer of material 1012 is positioned adjacent and external to the first layer of material 1010 such that their respective surfaces are positioned adjacent to each other to define a pocket space therebetween. When assembled, the perimeter edge 1022 of the second layer of material 1012 is affixed along its length to the perimeter edge 1014 of the first layer of material 1010. It is further contemplated herein, that the perimeter edges 1014 and 1022 are affixed to the perimeter edges 714 and 722 of the first and second layers 710/712 of the front portion 110 to form side margin 130. Similarly, the perimeter edge 1024 of the second layer of material 1012 is affixed along its length to the perimeter edge 1016 of the first layer of material 1010. It is further contemplated herein, that the perimeter edges 1016 and 1024 are affixed to the perimeter edge 818 of the first layer of material 810 of the back portion 112 to form side margin 216.

Continuing, when assembled, the aperimeter edge 1026 of the second layer of material 1012 is affixed along its length to the perimeter edge 1018 of the first layer of material 1010. To form the opening 157 to the pocket 156, the perimeter edge 1028 of the second layer of material 1012 is not affixed (or is unaffixed) to the perimeter edge 1020 of the first layer of material 1010 along its length to provide access to the pocket 156.

Figure 11A:
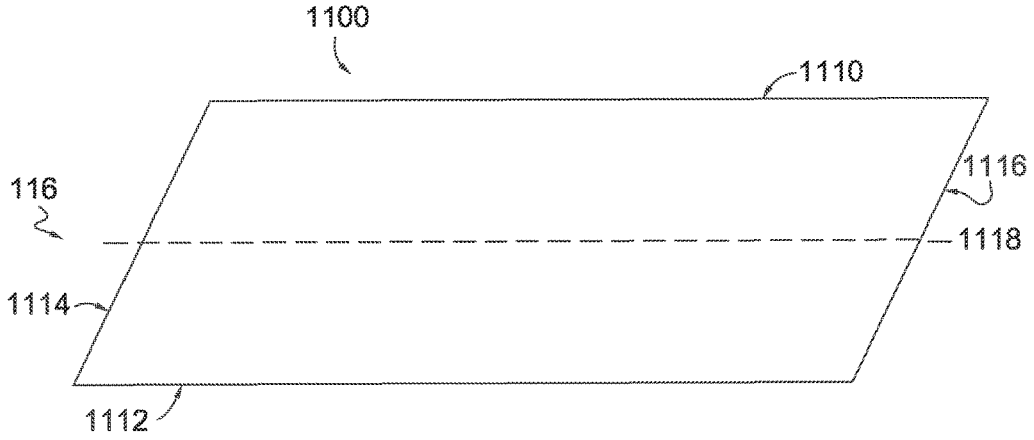
FIGS. 11A and 11B illustrate a construction of an underband portion of the exemplary bra of FIGS. 1 and 2 in accordance with aspects herein.
Figure 11B:
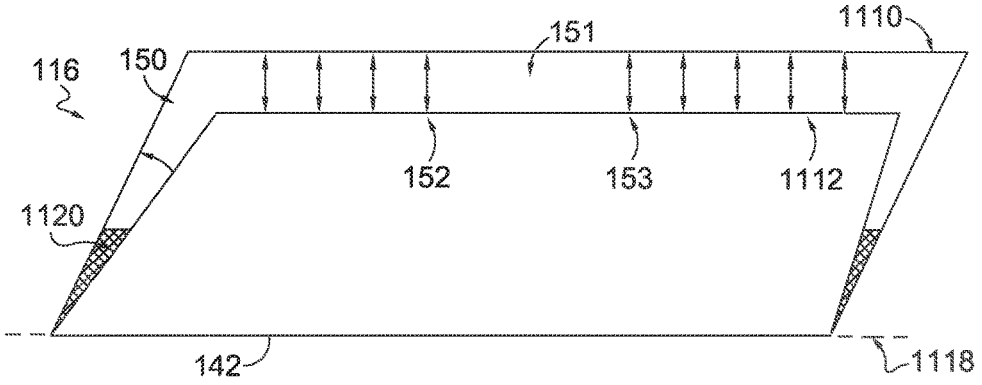

FIG. 11A and FIG. 11B illustrate an exemplary construction for the underband portion 116 of the bra 100 in accordance with aspects herein. FIG. 11A illustrates a layer of material 1100 in an unfolded state. The layer of material 1100 may be defined by perimeter edge 1110, perimeter edge 1112, and perimeter edges 1114 and 1116. The layer of material 1100 may be bisected along its length by a hypothetical fold line 1118. As illustrated in FIG. 11B, to assemble the underband portion 116 and to form the pocket 150, the layer of material 1100 may be folded along the hypothetical fold line 1118 such that the perimeter edge 1112 is aligned with or is coincident with the perimeter edge 1110. The perimeter edge 1112 may then be discontinuously affixed to the perimeter edge 1110 as indicated by the arrows (i.e., the arrows represent areas where the edges 1110 and 1112 are affixed.) The area where the perimeters edges 1110 and 1112 are not affixed (or unaffixed) comprises the opening 151 to the pocket 150. Reference numerals 152 and 153 denote the boundaries of the opening 151. It is contemplated herein, that the opening 151 may extend along a greater length of the underband portion 116 than shown. It is also contemplated herein, that more than one opening may be formed by discontinuously affixing the perimeter edges 1110 and 1112 at other pre-selected areas. Any and all aspects, and any variation thereof, are contemplated as being within aspects herein.

To affix the underband portion 116 to the bra 100, the perimeter edge 1110 may be affixed along its length to the lower margin 128 of the front portion 110, the lower margins 135 of the side portions 114 and 115, and the lower margin 212 of the back portion 112. However, to maintain the opening 151 to the pocket 150, the perimeter edge 1112 may be continuously affixed to the lower margins 135 of the side portions 114 and 115 and to the lower margin 212 of the back portion 112 but be discontinuously affixed to the lower margin 128 of the front portion 110. In other words, the perimeter edge 1112 may not be affixed (or unaffixed) to the lower margin 128 of the front portion 110 where the opening 151 is desired to be maintained.

Figure 12:
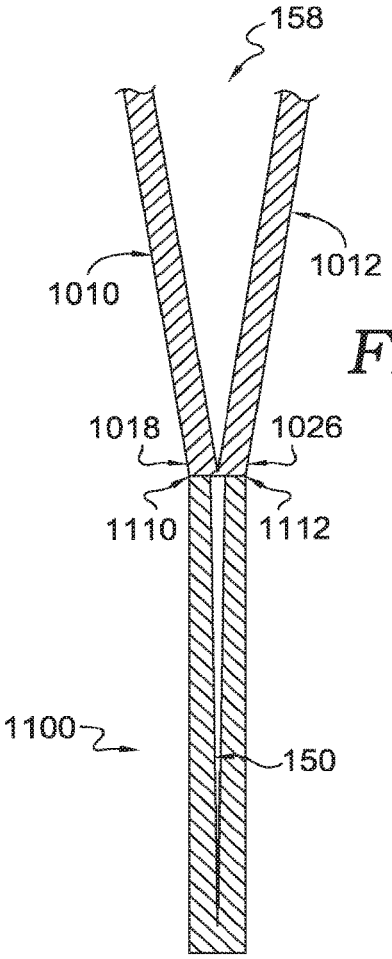
FIG. 12 illustrates an exemplary cross-section taken at cut line 12-12 of FIG. 1 in accordance with aspects herein.
Figure 13:
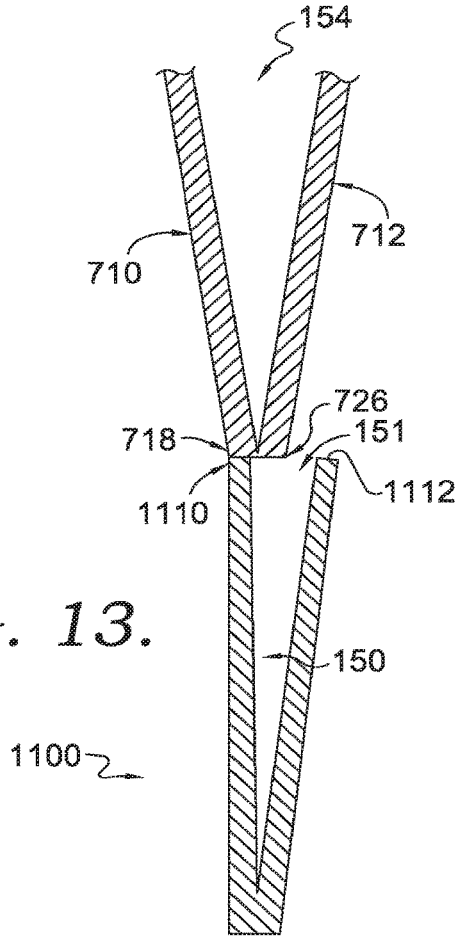
FIG. 13 illustrates an exemplary cross-section taken at cut line 13-13 of FIG. 1 in accordance with aspects herein.

This aspect is shown in FIGS. 12 and 13, where FIG. 12 represents a cross-sectional view taken along cut line 12-12 of FIG. 1, and FIG. 13 represents a cross-sectional view taken along cut line 13-13 of FIG. 1 in accordance with aspects herein. With respect to FIG. 12, the perimeter edges 1110 and 1112 of the layer of material 1100 forming the underband portion 116 are both shown being affixed to the perimeter edges 1018 and 1026 of the first and second layers of material 1010 and 1012 respectively of the side portion 114. FIG. 12 further illustrates the pocket 158 formed between the layers of material 1010/1012 in the side portion 114, and the pocket 150 formed when the layer of material 1100 is folded to form the underband portion 116. In exemplary aspects, the pocket 150 may be configured to extend around the circumference of the underband portion 116.

With respect to FIG. 13, the cross-sectional view is taken along the front portion 110 of the bra 100 in an area corresponding to the central portion 124 between the breast contacting surfaces 120 and 122. In this view, just the perimeter edge 1110 of the layer of material 1100 forming the underband portion 116 is affixed to the first and second layers of material 710/712 of the front portion 110 via the perimeter edges 718 and 726 of the layers 710/712. The perimeter edge 1112 of the layer of material 1100 is unaffixed to form the opening 151 to the pocket 150. FIG. 13 further illustrates the pocket 154 formed between the first and second layers of material 710/712 forming the front portion 110.

Returning to FIG. 11B, as mentioned, the layer of material 1100 forming the underband portion 116 may comprise an elastically resilient material. To augment the elastic nature of the underband portion 116 an optional elastically resilient band 1120 may be positioned in the pocket 150 adjacent the lower margin 142 of the underband portion 116 (although other locations are contemplated herein).

With continued respect to the underband portion 116, although described as being formed from a layer of material that is folded along a hypothetical fold line, it is also contemplated herein, that the underband portion 116 may be formed from two or more layers of material that are joined together along their perimeter edges. Any and all aspects, and any variation thereof, are contemplated as being within aspects herein.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra comprising:

a front portion;

a back portion;

a pair of bra side portions connecting the front portion and the back portion of the bra; and an underband portion extending from a lower margin of the front portion, the back portion, and the pair of bra side portions of the bra, the underband portion comprising at least an underband first layer of material and an underband second layer of material positioned adjacent and external to the underband first layer of material to form a pocket space, wherein an upper edge of the underband second layer of material is affixed to an upper edge of the underband first layer of material at a front aspect of the bra at both a first end and a second end of an unaffixed portion of the upper edge of the underband second layer of material and the upper edge of the underband first layer of material to form a pocket opening to the pocket space.

2. The bra of claim 1, wherein the front portion comprises at least a first breast contacting surface, a second breast contacting surface, and a central portion interposed between the first breast contacting surface and the second breast contacting surface.

3. The bra of claim 2, wherein the pocket opening to the pocket space is positioned generally inferior to the central portion.

4. The bra of claim 1, wherein the pocket space extends along a length of the underband portion.

5. The bra of claim 1, wherein the pocket space extends along a portion of a length of the underband portion.

6. The bra of claim 1, wherein at least the underband first layer of material comprises a knit textile.

7. The bra of claim 1, wherein the pocket opening to the pocket space is reinforced with an additional material.

8. The bra of claim 7, wherein the additional material comprises a fabric material.

9. A bra comprising:

a front portion;

a back portion comprising:

a back first layer of material having a superior perimeter edge and an inferior perimeter edge, a back second layer of material positioned adjacent and external to the back first layer of material to form a first pocket space, the back second layer of material having at least a superior perimeter edge and an inferior perimeter edge, wherein the inferior perimeter edge of the back second layer of material is affixed to the back first layer of material, and wherein the superior perimeter edge of the back second layer of material is affixed to the back first layer of material at both a first end and a second end of an unaffixed portion of the superior perimeter edge of the back second layer of material and the back first layer of material to form a first pocket opening in communication with the first pocket space, and a back third layer of material positioned adjacent and external to the back first layer of material to form a second pocket space, the back third layer of material having at least a superior perimeter edge generally coincident with the inferior perimeter edge of the back second layer of material, the back third layer of material further having an inferior perimeter edge, wherein the inferior perimeter edge of the back third layer of material is affixed to the back first layer of material, and wherein the superior perimeter edge of the back third layer of material is affixed to the back first layer of material at both a first end and a second end of an unaffixed portion of the superior perimeter edge of the back third layer of material and the back first layer of material to form a second pocket opening in communication with the second pocket space; and a pair of bra side portions connecting the front portion and the back portion of the bra.

10. The bra of claim 9, wherein one or more of the back first layer of material, the back second layer of material, and the back third layer of material comprises a mesh material.

11. The bra of claim 9, wherein the first pocket opening is linear and the second pocket opening is linear, and wherein the first pocket opening is in parallel alignment with the second pocket opening.

12. The bra of claim 9, wherein the front portion comprises a front first layer of material and a front second layer of material positioned adjacent and external to the front first layer of material to form a third pocket space that extends across the front portion of the bra.

13. The bra of claim 12, wherein a perimeter edge of the front second layer of material of the front portion is affixed to a perimeter edge of the front first layer of material of the front portion at both a first end and a second end of an unaffixed portion of the perimeter edge of the front second layer of material of the front portion and the perimeter edge of the front first layer of material of the front portion to form a third pocket opening in communication with the third pocket space.

14. The bra of claim 13, wherein the third pocket opening is positioned at an upper margin of the front portion.

15. The bra of claim 12, wherein the third pocket space extends continuously and without interruption along the front portion.

16. A bra comprising:

a front portion;

a back portion;

a pair of bra side portions connecting the front portion and the back portion of the bra, at least one of the pair of bra side portions comprising a side first layer of material and a side second layer of material positioned adjacent and external to the side first layer of material to form a first pocket space, wherein an upper edge of the side second layer of material of the side portion is affixed to an upper edge of the side first layer of material of the side portion at both a first end and a second end of an unaffixed portion of the upper edge of the side first layer of material of the side portion and the upper edge of the side second layer of material of the side portion to form a first pocket opening to the first pocket space; and an underband portion extending from a lower margin of the front portion, the back portion, and the pair of bra side portions of the bra, the underband portion comprising at least an underband first layer of material and an underband second layer of material positioned adjacent and external to the underband first layer of material to form a second pocket space, wherein an upper edge of the underband second layer of material of the underband portion is affixed to an upper edge of the underband first layer of material of the underband portion at a front aspect of the bra at both a first end and a second end of an unaffixed portion of the upper edge of the underband second layer of material of the underband portion and the upper edge of the underband first layer of material of the underband portion to form a second pocket opening to the second pocket space.

17. The bra of claim 16, wherein the front portion comprises at least a first breast contacting surface, a second breast contacting surface, and a central portion interposed between the first breast contacting surface and the second breast contacting surface.

18. The bra of claim 17, wherein the second pocket opening to the second pocket space is positioned generally inferior to the central portion.

19. The bra of claim 16, wherein the second pocket space extends along a length of the underband portion.

20. The bra of claim 19, wherein the second pocket space extends along a portion of the length of the underband portion.

* * * * *